US010526900B2

(12) United States Patent
Tham et al.

(10) Patent No.: US 10,526,900 B2
(45) **Date of Patent: *Jan. 7, 2020**

(54) SHROUDED TURBINE BLADE

(71) Applicant: Siemens Aktiengesellschaft, München (DE)

(72) Inventors: Kok-Mun Tham, Oviedo, FL (US); Ching-Pang Lee, Cincinnati, OH (US); Eric Chen, Cincinnati, OH (US); Steven Koester, Toledo, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 189 days.

This patent is subject to a terminal disclaimer.

(21) Appl. No.: 15/576,295

(22) PCT Filed: Jun. 29, 2015

(86) PCT No.: PCT/US2015/038221

§ 371 (c)(1),
(2) Date: Nov. 22, 2017

(87) PCT Pub. No.: WO2017/003416

PCT Pub. Date: Jan. 5, 2017

(65) Prior Publication Data

US 2018/0179900 A1 Jun. 28, 2018

(51) Int. Cl.

| | |
|---|---|
| ***F01D 5/22*** | (2006.01) |
| ***F01D 5/18*** | (2006.01) |
| ***F01D 11/08*** | (2006.01) |

(52) U.S. Cl.

CPC ..... *F01D 5/225* (2013.01); *F01D 5/186* (2013.01); *F01D 11/08* (2013.01);
(Continued)

(58) Field of Classification Search

CPC ..... F01D 5/225; F01D 5/186; F01D 11/08; F01D 5/20; F05D 2220/32; F05D 2240/307; F05D 2260/202

See application file for complete search history.

(56) References Cited

U.S. PATENT DOCUMENTS

| | | | |
|---|---|---|---|
| 5,350,277 | A | 9/1994 | Jacala et al. |
| 5,531,568 | A | 7/1996 | Broadhead |

(Continued)

FOREIGN PATENT DOCUMENTS

| | | | |
|---|---|---|---|
| EP | 1561904 | A2 | 8/2005 |
| JP | 2000291405 | A | 10/2000 |

(Continued)

OTHER PUBLICATIONS

PCT International Search Report and Written Opinion of International Searching Authority dated Mar. 15, 2016 corresponding to PCT International Application No. PCT/US2015/038221 filed Jun. 29, 2015.

*Primary Examiner* — Kenneth J Hansen
*Assistant Examiner* — Eric J Zamora Alvarez

(57) ABSTRACT

A turbine component including a shrouded airfoil with a flow conditioner configured to direct leakage flow and coolant to be aligned with main hot gas flow is provided. The flow conditioner is positioned on a shroud base radially adjacent to the tip of the airfoil and includes a ramped radially outer surface positioned further radially inward than a radially outer surface of the shroud base. The ramped radially outer surface extends from a first edge to a second edge in a direction generally from the suction side to the pressure side of the airfoil, such that the first edge is positioned further radially inward than the second edge. Multiple coolant ejection holes are positioned on the ramped
(Continued)

radially outer surface. The coolant ejection holes are connected fluidically to an interior of the airfoil.

11 Claims, 7 Drawing Sheets

(52) U.S. Cl.
CPC .... *F05D 2220/32* (2013.01); *F05D 2240/307* (2013.01); *F05D 2260/202* (2013.01)

(56) References Cited

U.S. PATENT DOCUMENTS

| | | | | |
|---|---|---|---|---|
| 6,491,498 | B1 | 12/2002 | Seleski et al. | |
| 7,686,581 | B2 * | 3/2010 | Brittingham | F01D 5/187 416/97 R |
| 9,009,965 | B2 * | 4/2015 | Tragesser | F01D 5/225 29/889.1 |
| 9,494,043 | B1 * | 11/2016 | Lee | F01D 11/08 |
| 2005/0191182 | A1 | 9/2005 | Seleski | |
| 2009/0180894 | A1 * | 7/2009 | Brittingham | F01D 5/225 416/97 R |
| 2012/0107123 | A1 | 5/2012 | Schlemmer et al. | |

FOREIGN PATENT DOCUMENTS

| | | | |
|---|---|---|---|
| JP | 2009168014 | A | 7/2009 |
| JP | 2013117227 | A | 6/2013 |

* cited by examiner

SHROUDED TURBINE BLADE

BACKGROUND

1. Field

This invention is directed generally to turbine components, and more particularly to shrouded turbine airfoils.

2. Description of the Related Art

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures.

A turbine blade is formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. Some turbine blades include outer shrouds, as shown in FIG. 1A, attached to the tips.

Tip leakage loss, as shown in FIG. 1B, is essentially lost opportunity for work extraction and also contributes towards aerodynamic secondary loss. To reduce overtip leakage, shrouded blades typically include a circumferential knife edge for running tight tip gaps. The turbine tip shrouds are also used for the purpose of blade damping.

Some modern tip shrouds are scalloped, as opposed to a full ring, to reduce shroud weight and hence lower blade pull loads. The material removed by scalloping is indicated by the shaded region in FIG. 1A. The removal of material by scalloping is detrimental to turbine aerodynamic efficiency, as the shroud coverage is now reduced and parasitic leakage increases and augments the secondary aerodynamic efficiency.

Some shrouded blades are also internally cooled, and fences have been used in the past to extract work from the ejected blade coolant, for example, as disclosed in U.S. Pat. No. 5,531,568 A.

SUMMARY

A turbine component including a shrouded airfoil with a flow conditioner configured to direct leakage flow and ejected coolant flow to be aligned with main hot gas flow is provided. The flow conditioner is positioned on a radially outer surface of the shroud base radially adjacent to the tip of the airfoil. The flow conditioner includes a ramped radially outer surface positioned further radially inward than the radially outer surface of the shroud base. The ramped radially outer surface extends from a first edge to a second edge in a direction generally from the suction side to the pressure side of the airfoil, such that the first edge is positioned further radially inward than the second edge. A plurality of coolant ejection holes are positioned on the ramped radially outer surface. The plurality of coolant ejection holes are connected fluidically to an interior of the airfoil.

In one embodiment, the airfoil is generally elongated and has a leading edge, a trailing edge, a pressure side, a suction side on a side opposite to the pressure side, a tip at a radially outer end of the airfoil, a root coupled a radially inner end of the airfoil for supporting the airfoil and for coupling the airfoil to a rotor disc. A shroud is coupled to the tip of the airfoil. The shroud extends in a direction generally from the pressure side toward the suction side and extends circumferentially in a turbine engine. The shroud is formed at least in part by a shroud base coupled to the tip of the airfoil and a knife edge seal extending radially outward from the shroud base.

In one embodiment, the first edge is generally aligned with a suction side of the generally elongated airfoil at an intersection of the generally elongated airfoil and the shroud.

In one embodiment, the first edge of the ramped radially outer surface of the flow conditioner may be positioned further radially inward than the radially outer surface of the shroud base. A radially extending wall surface connects the ramped radially outer surface of the flow conditioner with the radially outer surface of the shroud base. The ramped radially outer surface of the flow conditioner makes an angle with the radially extending wall surface.

In a still further embodiment, the angle of the ramped radially outer surface with the radially extending wall surface varies along the first edge as a function of a profile of the airfoil. The angle of the ramped radially outer surface may vary along the first edge so as to be progressively shallower in a direction from a leading edge towards a trailing edge of the airfoil profile.

In one embodiment, the second edge generally has the profile of the pressure side of the generally elongated airfoil at an intersection of the generally elongated airfoil and the shroud. The second edge of the ramped radially outer surface of the flow conditioner may be the same radial level as the radially outer surface of the shroud base and form an intersection between the ramped radially outer surface of the flow conditioner and the radially outer surface of the shroud base.

In one embodiment, the flow conditioner is formed by a cutout defining a region of reduced mass on the radially outer surface of the shroud base.

The shroud base has an upstream section extending upstream of the knife edge seal and a downstream section extending downstream of the knife edge seal. In one embodiment, the flow conditioner may be positioned on the downstream section of the shroud base. In an alternate embodiment, the flow conditioner is positioned on the upstream section of the shroud base. In a preferred embodiment, the flow conditioner comprises a downstream flow conditioner positioned on the downstream section of the shroud base and an upstream flow conditioner positioned on the upstream section of the shroud base.

An advantage of the flow conditioner is that the flow conditioner promotes work extraction in the shroud cavity. The ramp also acts like a fence to discourage leakage flow and coolant flow from the pressure to the suction side of the airfoil.

Another advantage of the flow conditioner is that the flow conditioner aligns overtip leakage flow and the ejected coolant flow to match main gas flow. The overtip leakage and ejected coolant in the shroud cavity needs to re-enter the main gas path eventually. A feature of the inventive design is not only to extract some work but also condition the leakage and coolant flow so that it results in reduced aerodynamic loss upon re-introduction into the main gas path Yet another advantage of the flow conditioner is that the flow conditioner results in reduced weight of the shroud. This results in reduced airfoil stress and reduced airfoil section required to carry the shroud load, which results in reduced aerodynamic profile loss, thereby increasing aerodynamic efficiency of the airfoil. The reduced airfoil stress also increases blade creep resistance.

Another advantage of the flow conditioner is that it spreads the tip cooling flow to a wider range for tip shroud cooling. In the circumferential direction, the ramp increases flow area locally at the airfoil shroud, hence flow velocity decreases and pressure increases. This results in a pressure surface on the shroud to encourage work extraction.

These and other embodiments are described in more detail below.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1A:
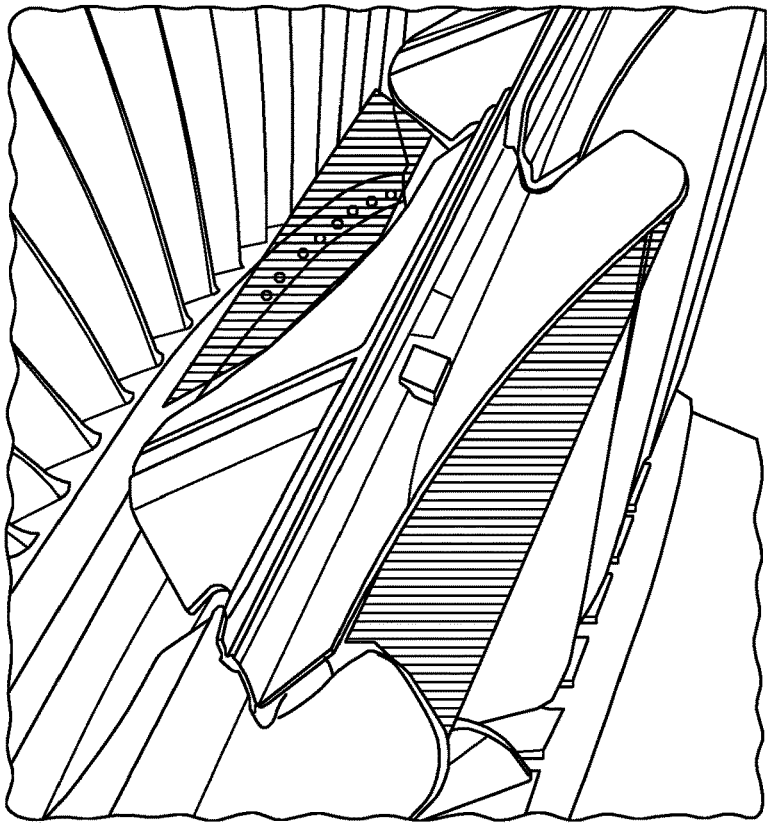
FIG. 1A PRIOR ART
FIG. 1A is a perspective view of a conventional turbine airfoil with an outer shroud.
Figure 1B:
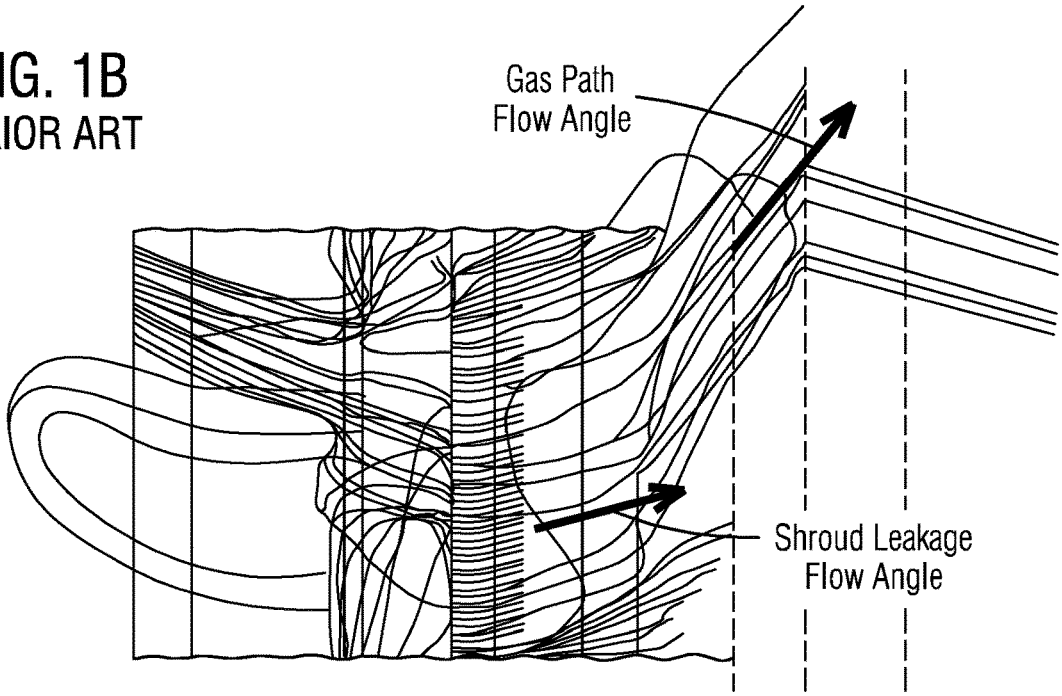
FIG. 1B PRIOR ART
FIG. 1B is a perspective view of the conventional turbine airfoil shown together with leakage flow and main gas flow.
Figure 2:
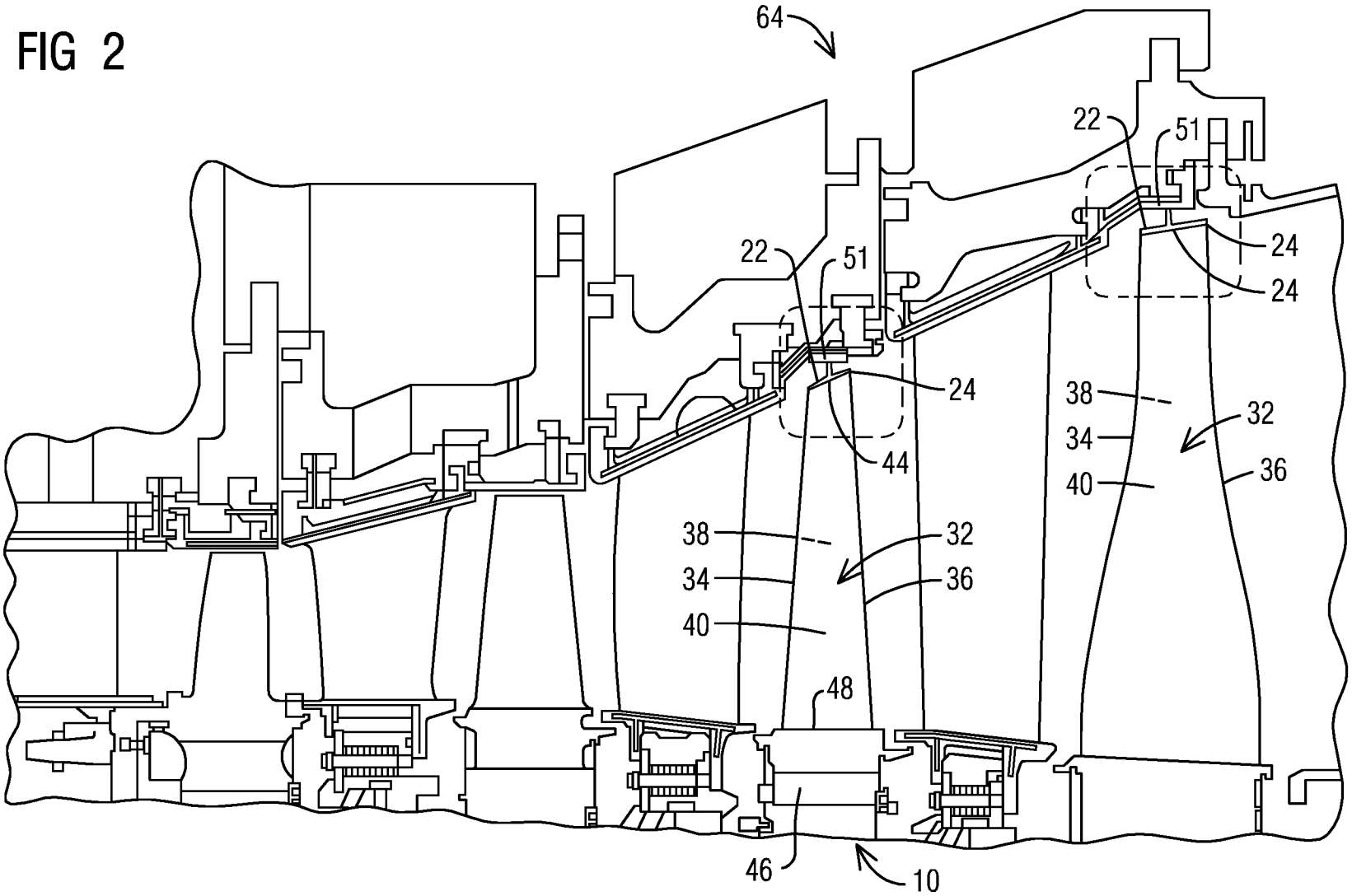
FIG. 2 is a perspective view of a gas turbine engine with shrouded turbine airfoils with at least one flow conditioner according to embodiments of the present invention.

Referring to FIG. 2, a turbine engine 64 is illustrated, that comprises a turbine component 10 wherein embodiments of the present invention may be incorporated. In the illustrated embodiment, the turbine component 10 is a turbine blade. The turbine component 10 is formed from a generally elongated airfoil 32 extending in a generally radial direction in the turbine engine 64 from a rotor disc. The airfoil 32 includes a leading edge 34, a trailing edge 36, a pressure side 38, a suction side 40 on a side opposite to the pressure side 38, a tip 24 at a first radially outer end 44 of the airfoil 32, a root 46 coupled to the airfoil 32 at a second radially inner end 48 of the airfoil 32 for supporting the airfoil 32 and for coupling the airfoil 32 to the rotor disc. The turbine component 10 may include one or more shrouds 22, referred to as outer shrouds, coupled to the tip 24 of the generally elongated airfoil 32. The shroud 22 may extend in a direction generally from the pressure side 38 toward the suction side 40 and may extend circumferentially in the turbine engine 64. The shroud 22 may be formed at least in part by a shroud base 20 coupled to the tip 24 of the generally elongated airfoil 32 and a knife edge seal 50 extending radially outward from the shroud base 20. The knife edge seal 50 extends in a circumferential direction of the turbine engine 64 and runs tight tip gaps against a honeycomb structure 51 on the stator of the turbine engine. 64, thereby reducing overtip leakage.

Figure 3:
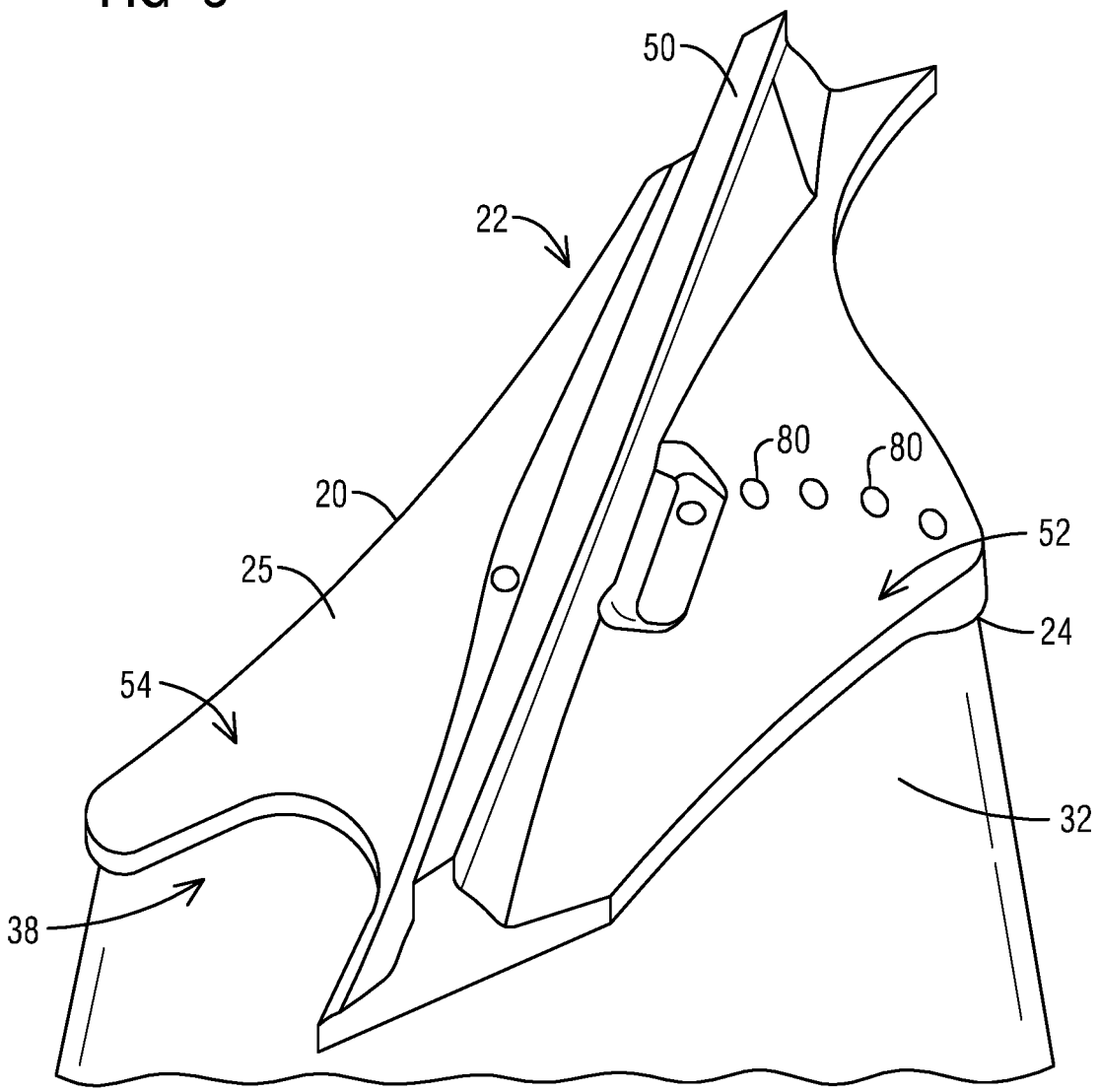
FIG. 3 is a perspective top view in a direction from a turbine casing towards a rotor hub illustrating a shrouded airfoil.

As shown in FIG. 3, the shroud base 20 may have an upstream section 52 extending upstream of the knife edge seal 50 with respect to a main gas flow and a downstream section 54 extending downstream of the knife edge seal 50 with respect to the main gas flow. The main gas flow refers to the flow of the driving medium of the turbine engine 64. A plurality of coolant passages 80 are provided on the shroud base 20. The coolant passages 80 open through a radially outer surface 25 of the shroud base 20 and direct a coolant from the hollow interior of the airfoil 32 to provide film cooling on the radially outer surface 25 of the shroud base 20.

Figure 4:
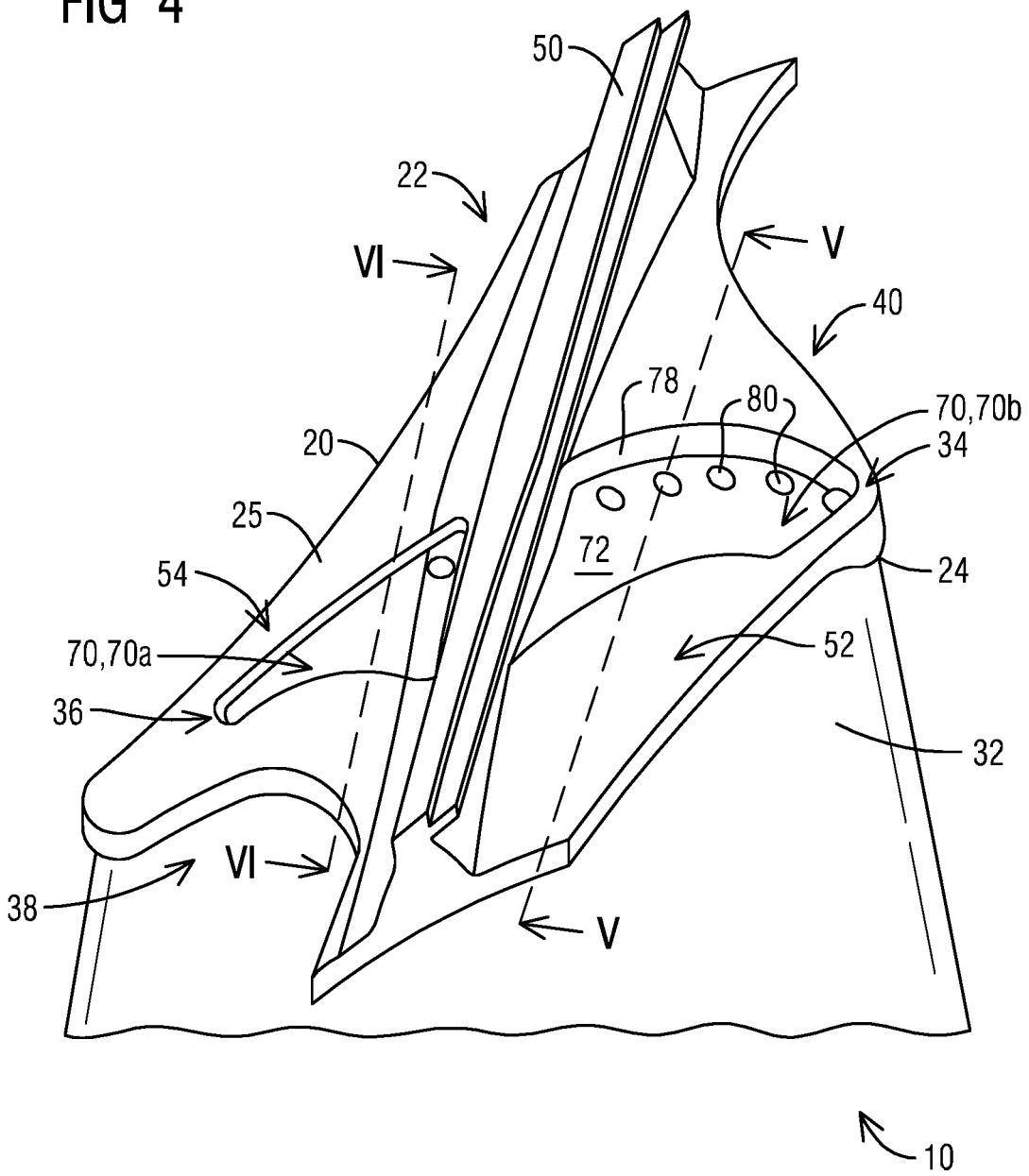
FIG. 4 is a perspective top view in a direction from a turbine casing towards a rotor hub illustrating a shrouded airfoil having a flow conditioner according to one embodiment.
Figure 5:
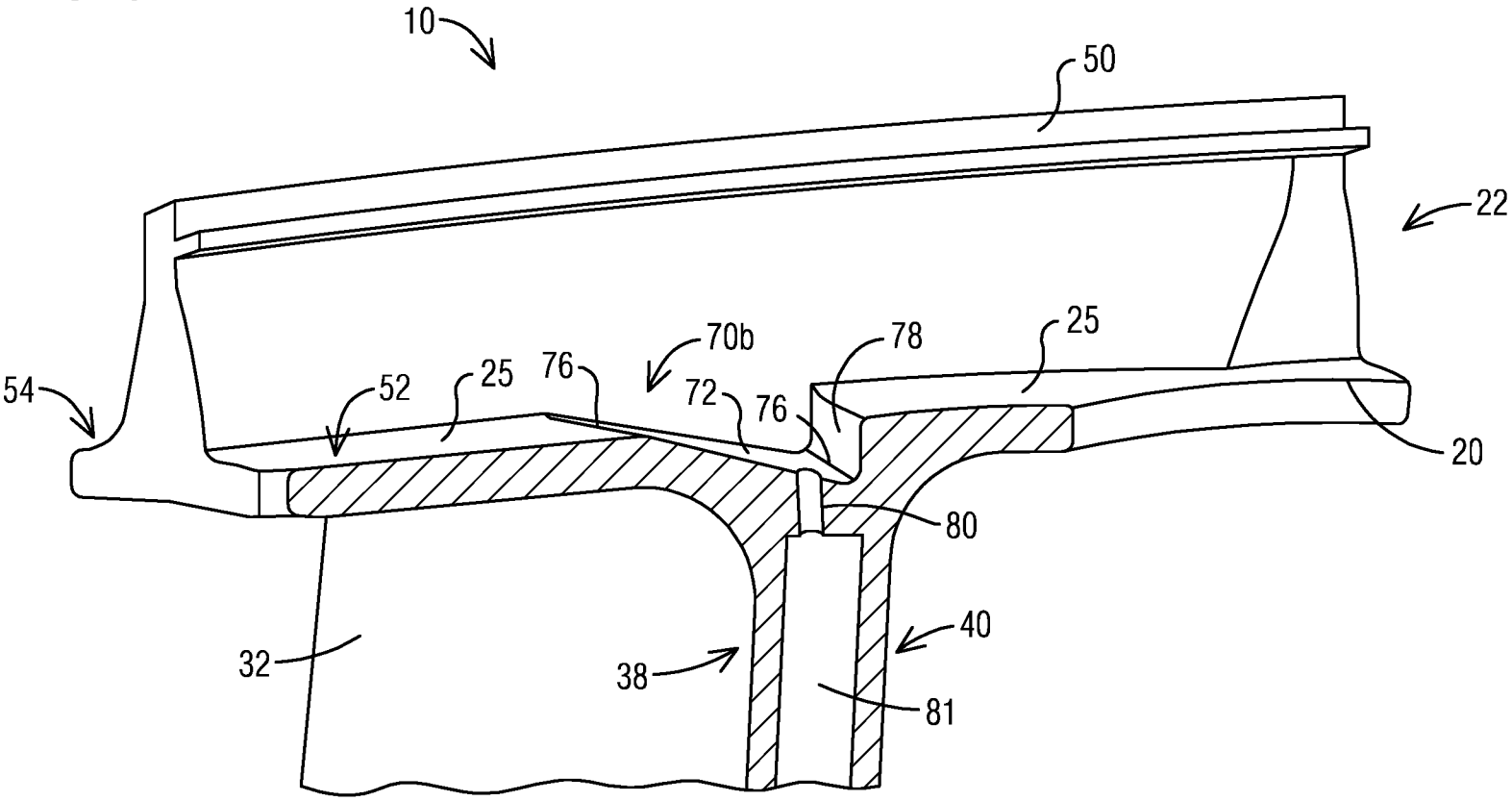
FIG. 5 is a view along the section V-V in FIG. 3, which illustrates an upstream flow conditioner looking in a direction of flow.
Figure 6:
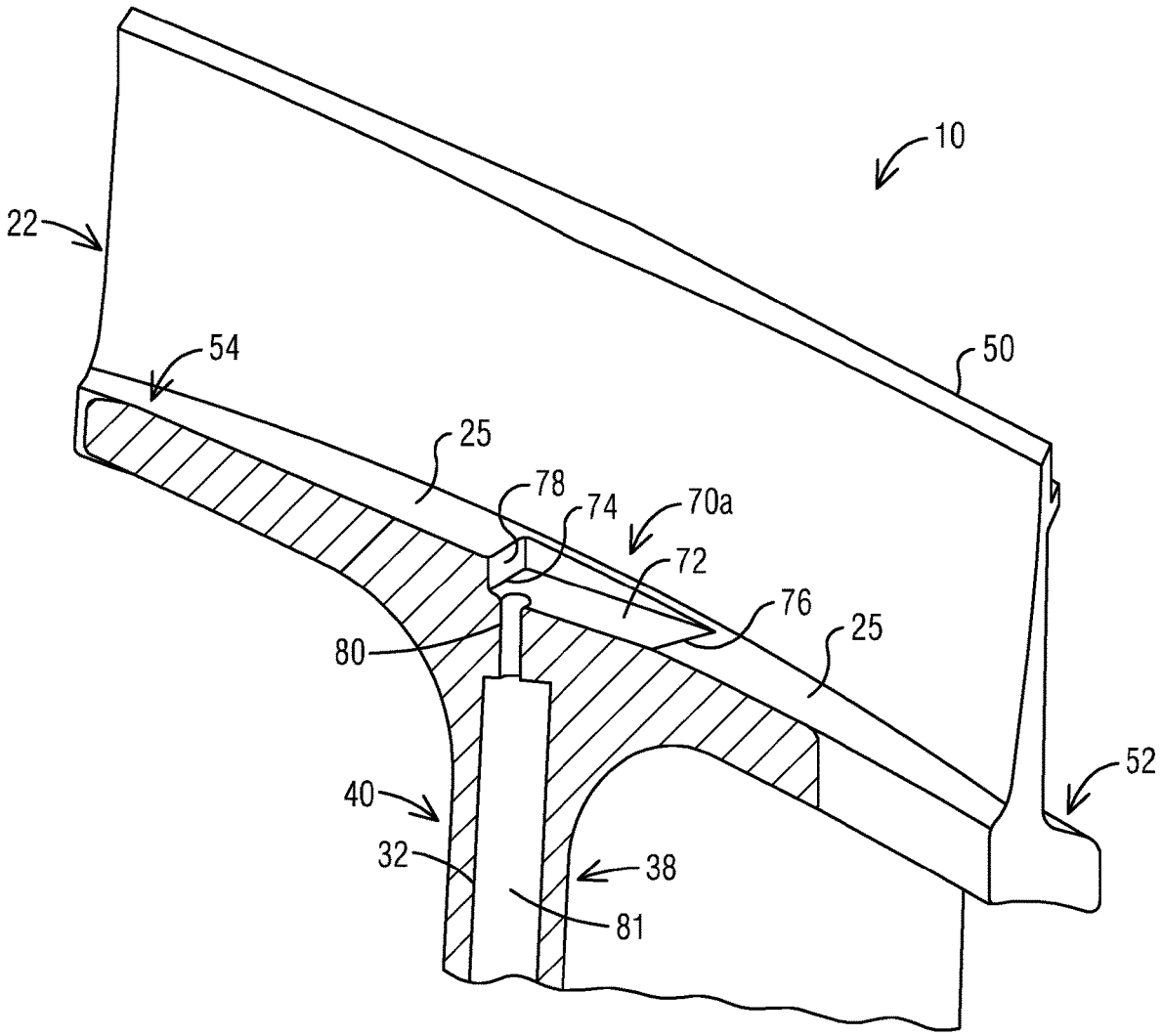
FIG. 6 is a view along the section VI-VI in FIG. 3, which illustrates a downstream flow conditioner looking against a direction of flow.

The coolant ejected through the passages 80, along with the overtip leakage flow, eventually enters the main gas flow. Referring to FIGS. 4-6, an example embodiment of a flow conditioner 70 is illustrated that conditions the ejected coolant flow from the outer surface 25 of the shroud base 20 along with the overtip leakage flow for better work extraction and reduced aerodynamic losses. As shown, the illustrated flow conditioner 70 is positioned on the radially outer surface 25 of the shroud base 20. The flow conditioner 70 is positioned radially adjacent to the airfoil 32. That is to say, the flow conditioner 70 is positioned on the part of the shroud base 20 which is immediately above the airfoil 32.

The flow conditioner 70 includes a ramped radially outer surface 72 positioned further radially inward than the radially outer surface 25 of the shroud base 20. As illustrated in FIGS. 5 and 6, the ramped radially outer surface 72 extends from a first edge 74 to a second edge 76 in a direction generally from the suction side 40 to the pressure side 38 of the airfoil 32. The ramp is oriented such that the first edge 74 is positioned further radially inward than the second edge 76. A plurality of coolant ejection holes 80 are positioned on the ramped radially outer surface 72 of the flow conditioner 70. The coolant ejection holes 80 are connected fluidically to an interior 81 of the airfoil 32.

In the illustrated embodiment, the flow conditioner 70 is disposed on both, the upstream section 52 and the downstream section 54 of the shroud base 20, i.e., on either side of the knife edge seal 50. The illustrated flow conditioner 70 thus has a first portion, namely a downstream flow conditioner 70*a* positioned on the downstream section 54 and a second portion, namely an upstream flow conditioner 70*b* positioned on the upstream section 52. In alternate embodiments, the flow conditioner 70 may comprise only a downstream flow conditioner 70*a* or only an upstream flow conditioner 70*b*. FIGS. 5 and 6 respectively illustrate sectional views of the upstream flow conditioner 70*b* and the downstream flow conditioner 70*a*.

In one embodiment, the first edge 74 of the ramped radially outer surface 72 is generally aligned with the suction side 40 of the airfoil 32 at an intersection of the generally elongated airfoil 32 and the shroud 22. That is so say, the first edge 74 (not shown in FIG. 4) is positioned immediately above the suction side 40 of the tip 24 of the airfoil 32 and generally follows the contour of the suction side 40 at the airfoil tip 24, as visible in FIG. 4. The second edge 76 (not shown in FIG. 4) may generally have the profile of the pressure side 38 of the airfoil 32 at the intersection of the airfoil 32 and the shroud 22.

As shown in FIG. 5 and FIG. 6, the first edge 74 of the ramped radially outer surface 72 is positioned further radially inward than the radially outer surface 25 of the shroud base 20. A radially extending wall surface 78 connects the ramped radially outer surface 72 with the radially outer surface 25 of the shroud base 20. The radially extending wall surface 78 is correspondingly aligned with the suction side 40 of the airfoil 32. In the illustrated embodiment, the second edge 76 of the ramped radially outer surface 72 is at the same radial level as the radially outer surface 25 of the shroud base 20 and forms an intersection between the ramped radially outer surface 72 and the radially outer surface 25 of the shroud base 20.

The ramped radially outer surface 72 makes an angle with the radially extending wall surface 78 that defines a ramp gradient. The angular orientation of the ramped radially outer surface 72 with the radially extending wall surface 78 provides a fence-like structure to shield overtip leakage flow and the coolant ejected from the holes 80 from flowing from the pressure side 38 to the suction side 40 of the airfoil 32. Such a feature promotes work extraction in the shroud cavity.

The angle that the ramped radially outer surface 72 makes with the radially extending wall surface 78 may be related to the profile of the airfoil 32. In the illustrated embodiment, angle of the ramp varies along the contour of the first edge as a function of a profile of the airfoil. In particular, the angle of the ramp may vary so as to be progressively shallower in a direction from a leading edge 34 towards a trailing edge 36 of the airfoil profile. As a result, the ramp gradient at the upstream flow conditioner 70*b* is generally steeper than the ramp gradient at the downstream flow conditioner 70*a*, as visible in FIG. 5 and FIG. 6. The inventive configuration of the ramp aligns the ejected coolant flow and the overtip leakage flow to match main flow, especially as they head towards main gas path re-entry.

In one embodiment, the flow conditioner 70 is formed by a cutout on the radially outer surface 25 of the shroud base 20. The cutout defines a region of reduced mass of the shroud base 20. This results in reduced airfoil stress and reduced airfoil section required to carry the shroud load, which in turn results in reduced aerodynamic profile loss, thereby increasing aerodynamic efficiency of the airfoil 32. The reduced airfoil stress also increases blade creep resistance. Another advantage of the reduced mass of the shroud base 20 is that the knife edge seal 50 experiences enhanced contact.

Figure 7:
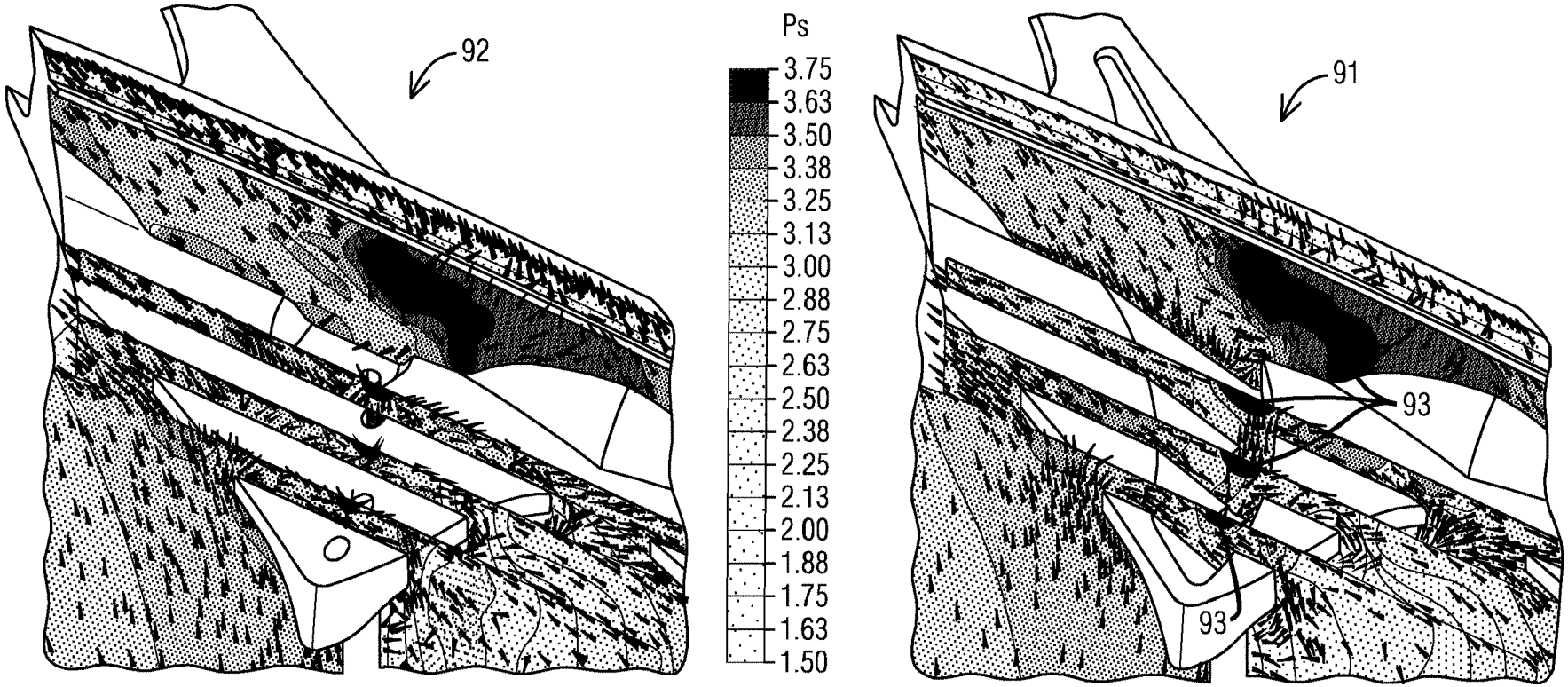
FIG. 7 illustrates CFD calculation results depicting contours of pressure and velocity vectors on a shrouded airfoil with a flow conditioner according to an embodiment of the present invention.

During use, hot gas in the main flow may pass through the tight gap between the shroud 22 and the turbine stator to form leakage flow. At the same time, airfoil coolant, typically comprising compressor air, flows from the interior 81 of the airfoil 32 through the shroud 22 and is ejected from the coolant holes 80 provided on the ramped radially outer surface 72 of the flow conditioner 70. The leakage flow and the ejected coolant flow are guided by the flow conditioner 70 to flow in a direction of the main hot gas flow downstream of the shrouded turbine airfoil 32. In at least one embodiment, the leakage flow and the ejected coolant flow strike the radially outward extending wall surface 78 of the leakage flow conditioner 70 and are redirected. In the circumferential direction, the radially outer surface of the leakage flow conditioner, by virtue of being oriented as a ramp, increases flow area locally at the shroud 22, hence, flow velocity decreases and static pressure increases resulting in a resultant pressure surface on the shroud 22 to encourage work extraction. This technical effect is verified by computational fluid dynamics calculations and may be demonstrated by way of depicting contours of pressure and velocity vectors on a shrouded airfoil as shown in FIG. 7. In the drawing, right portion 91 depicts contours of pressure and velocity vectors on a shrouded airfoil with a flow conditioner as per the illustrated embodiments, while the left portion depicts the same with a baseline configuration without the inventive flow conditioner. As seen, the depiction 91 shows relatively larger regions 93 of very high static pressure, evidently recovered as a result of the increase in flow area provided by the ramped flow conditioner, in comparison to the baseline configuration. Increased static pressure recovery promotes work extraction, which improves engine efficiency and power output.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A turbine component comprising:

an elongated airfoil having a leading edge, a trailing edge, a pressure side, a suction side on a side opposite to the pressure side, a tip at a radially outer end of the airfoil, a root coupled to a radially inner end of the airfoil for coupling the airfoil to a disc;

a shroud coupled to the tip of the airfoil;

wherein the shroud extends in a direction from the pressure side toward the suction side and extends circumferentially in a turbine engine;

wherein the shroud is formed at least in part by a shroud base coupled to the tip of the airfoil and a knife edge seal extending radially outward from the shroud base;

a flow conditioner positioned on a radially outer surface of the shroud base, radially adjacent to the tip of the airfoil, the flow conditioner comprising:

a ramped radially outer surface positioned further radially inward than the radially outer surface of the shroud base, the ramped radially outer surface extending from a first edge to a second edge in a direction the suction side to the pressure side of the airfoil, such that the first edge is positioned further radially inward than the second edge;

wherein a plurality of coolant ejection holes are positioned on the ramped radially outer surface, the plurality of coolant ejection holes being connected fluidically to an interior of the airfoil.

2. The turbine component according to claim 1, wherein the first edge is aligned with the suction side of the elongated airfoil at an intersection of the elongated airfoil and the shroud.

3. The turbine component according to claim 2, wherein the first edge of the ramped radially outer surface is positioned further radially inward than the radially outer surface of the shroud base, wherein a radially extending wall surface connects the ramped radially outer surface with the radially outer surface of the shroud base, and wherein the ramped radially outer surface makes an angle with the radially extending wall surface.

4. The turbine component according to claim 3, wherein the angle of the ramped radially outer surface with the radially extending wall surface varies along the first edge as a function of a profile of the airfoil.

5. The turbine component according to claim 4, wherein the angle of the ramped radially outer surface varies along the first edge so as to be progressively shallower in a direction from the leading edge towards the trailing edge of the airfoil.

6. The turbine component according to claim 1, wherein the second edge has a profile of the pressure side of the elongated airfoil at an intersection of the elongated airfoil and the shroud.

7. The turbine component according to claim 1, wherein the second edge of the ramped radially outer surface is at a same radial level as the radially outer surface of the shroud base and forms an intersection between the ramped radially outer surface and the radially outer surface of the shroud base.

8. The turbine component according to claim 1, wherein the flow conditioner is formed by a cutout defining a region of reduced mass on the radially outer surface of the shroud base.

9. The turbine component according to claim 1, wherein the shroud base has an upstream section extending upstream of the knife edge seal and a downstream section extending downstream of the knife edge seal, wherein the flow conditioner is positioned on the downstream section of the shroud base.

10. The turbine component according to claim 1, wherein the shroud base has an upstream section extending upstream of the knife edge seal and a downstream section extending downstream of the knife edge seal, wherein the flow conditioner is positioned on the upstream section of the shroud base.

11. The turbine component according to claim 1, wherein the shroud base has an upstream section extending upstream of the knife edge seal and a downstream section extending downstream of the knife edge seal, wherein the flow conditioner comprises a downstream flow conditioner positioned on the downstream section of the shroud base and an upstream flow conditioner positioned on the upstream section of the shroud base.

* * * * *